US008967440B2

(12) United States Patent
Chang

(10) Patent No.: US 8,967,440 B2
(45) Date of Patent: Mar. 3, 2015

(54) WRAPPING FILM DISPENSER

(76) Inventor: James Chang, Castro Valley, CA (US)

( * ) Notice: Subject to any disclaimer, the term of this patent is extended or adjusted under 35 U.S.C. 154(b) by 384 days.

(21) Appl. No.: 13/469,609

(22) Filed: May 11, 2012

(65) Prior Publication Data

US 2013/0299545 A1 Nov. 14, 2013

(51) Int. Cl.
*B26F 3/00* (2006.01)

(52) U.S. Cl.
USPC ..... 225/2; 225/4; 225/39; 225/46

(58) Field of Classification Search
CPC ..... B26F 3/02; B65H 35/10
USPC ..... 225/51, 81, 82, 39, 91, 4, 32, 42, 48, 225/63, 2; 242/522, 523.1; 83/648, 649
See application file for complete search history.

(56) References Cited

U.S. PATENT DOCUMENTS

| | | | | | |
|---|---|---|---|---|---|
| 2,031,033 | A | * | 2/1936 | Denebeim | 225/47 |
| 2,665,078 | A | * | 1/1954 | Krueger | 225/22 |
| 2,783,878 | A | * | 3/1957 | Traver | 225/44 |
| 2,834,646 | A | * | 5/1958 | Berg | 225/51 |
| 3,033,432 | A | * | 5/1962 | Code | 225/44 |
| 3,311,278 | A | * | 3/1967 | Brandon | 225/93 |
| 3,743,150 | A | * | 7/1973 | Eckart, Jr. | 225/9 |
| 3,790,053 | A | * | 2/1974 | Schiano et al. | 225/48 |
| 3,870,212 | A | | 3/1975 | Polk | |
| 4,196,647 | A | * | 4/1980 | Fish | 83/175 |
| 4,787,542 | A | | 11/1988 | Ruff et al. | |
| 5,146,828 | A | * | 9/1992 | Huang et al. | 83/570 |
| 5,630,563 | A | * | 5/1997 | Meisner et al. | 242/598.6 |
| 5,768,968 | A | | 6/1998 | Park et al. | |
| 6,105,481 | A | | 8/2000 | Schuler | |
| 6,585,138 | B2 | * | 7/2003 | Takayama | 225/41 |
| 6,749,097 | B1 | * | 6/2004 | McElhinny | 225/20 |
| 7,252,216 | B2 | | 8/2007 | Lin et al. | |
| 7,703,647 | B2 | * | 4/2010 | Gochanour | 225/90 |
| 8,113,400 | B1 | | 2/2012 | Santolalla | |
| D674,746 | S | * | 1/2013 | Zhang et al. | D13/102 |
| 8,714,428 | B2 | * | 5/2014 | Mallard et al. | 225/58 |

FOREIGN PATENT DOCUMENTS

GB WO0051927 A1 9/2000

* cited by examiner

*Primary Examiner* — Omar Flores Sanchez
(74) *Attorney, Agent, or Firm* — Ash Tankha; Lipton, Weinberger & Husick

(57) ABSTRACT

A wrapping film dispenser has a generally cylindrical container that defines a cavity for accommodating a wrapping film roll, and further defines a slot extending along its length for extracting a sheet of wrapping film through the slot. A gripping pad member is rigidly attached at a first lengthwise edge of the slot. A locking element is rigidly attached proximal to a second lengthwise edge of the slot. The locking element extends towards the gripping pad member, presses the extracted wrapping film sheet against the gripping pad member, and restricts movement and prevents roll back of the extracted wrapping film sheet. A cutting frame is rigidly attached proximal to the first lengthwise edge of the slot above the gripping pad member, and has a protruding element located at a predetermined location on the cutting frame for cutting the wrapping film sheet extracted out through the slot.

8 Claims, 14 Drawing Sheets

WRAPPING FILM DISPENSER

BACKGROUND

Conventional wrapping film dispensers generally include a container with a sharp serrated knife and/or a cutting blade attached to the container for cutting a sheet of a wrapping film. To wrap an item with a wrapping film extracted from a conventional wrapping film dispenser, a user has to open the container to draw out the wrapping film and tear the wrapping film along the cutting blade mounted on the container, which may result in the wrapping film inadvertently contacting other surfaces, for example, a user's hand about which the wrapping film may get wrapped, thereby making it difficult to wrap the item. Moreover, the cutting blade may cause injury to the user while the user operates the wrapping film dispenser with both hands and tries to cut the wrapping film, which makes the conventional wrapping film dispenser unsafe. Furthermore, since the conventional wrapping film dispenser requires the user to cut the wrapping film first and then wrap an item, the length of the wrapping film cut may be too much or too less which results in wastage of the wrapping film.

Furthermore, after cutting a sheet of wrapping film, the wrapping film may roll back into the container, making it difficult for the user to retrieve a leading edge of the wrapping film out of the container for subsequent extraction of another sheet of wrapping film out of the container. The user may therefore have to open the conventional wrapping film dispenser for subsequent usage, that is, to draw out the wrapping film and then close the conventional film dispenser to cut the drawn wrapping film, which leads to difficulties in wrapping an item.

Hence, there is a long felt but unresolved need for a safe, easy to operate, blade free wrapping film dispenser that allows dispensing of a wrapping film of a sufficient length for wrapping an item of any size without the user's hand being caught in the wrapping film, and that allows cutting of the wrapping film without the use of sharp cutting objects such as knifes, cutting blades, etc. Moreover, there is a need for a wrapping film dispenser that restricts movement of the wrapping film extracted out of a container of the wrapping film dispenser, thereby preventing the wrapping film from rolling back into the container. Furthermore, there is a need for a wrapping film dispenser that leaves a sufficient length of the wrapping film free to allow a user to easily extract another sheet of wrapping film from the container for subsequent usage. Furthermore, there is a need for a wrapping film dispenser that allows convenient insertion of a roll of wrapping film into the container.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The wrapping film dispenser disclosed herein addresses the above mentioned need for dispensing a wrapping film of a sufficient length for wrapping an item of any size without a user's hand being caught in the wrapping film, and for cutting the wrapping film without the use of sharp cutting objects such as knifes, cutting blades, etc. The wrapping film is, for example, a thin sheet of a flexible laminate plastic film, a metallic foil, etc., that may be used for wrapping or packaging an item such as a food item. Moreover, the wrapping film dispenser disclosed herein restricts movement of the wrapping film extracted out of a container of the wrapping film dispenser, thereby preventing the wrapping film from rolling back into the container. Furthermore, the wrapping film dispenser disclosed herein leaves a sufficient length of the wrapping film free to allow the user to easily extract another sheet of wrapping film from the container for subsequent usage. Furthermore, the wrapping film dispenser disclosed herein allows convenient insertion of a roll of wrapping film into the container.

The wrapping film dispenser disclosed herein comprises a generally cylindrical container that defines a cavity configured to accommodate a roll of a wrapping film. The cylindrical container further defines a slot extending along a length of the cylindrical container for extracting a sheet of wrapping film through the slot. In an embodiment, the wrapping film dispenser disclosed herein further comprises a key member having an opening for inserting a leading edge of the wrapping film, for guiding the roll of wrapping film into the cavity of the cylindrical container, and for guiding a sheet of wrapping film out through the slot of the cylindrical container. In an embodiment, the key member is configured to fit into a complementary groove defined on a lid that covers an open one of the opposing ends of the cylindrical container.

The wrapping film dispenser disclosed herein further comprises a gripping pad member, a locking element, and a cutting frame. The gripping pad member is rigidly attached on an upper outer surface of the cylindrical container at a first lengthwise edge of the slot. The gripping pad member extends along the length of the cylindrical container. The locking element is rigidly attached on a lower outer surface of the cylindrical container proximal to a second lengthwise edge of the slot. The locking element is, for example, of an arch shape and extends along the length of the cylindrical container. The locking element is rigidly attached on the lower outer surface of the cylindrical container proximal to the second lengthwise edge of the slot, for example, by hinge members. The locking element is configured to extend from the lower outer surface of the cylindrical container towards the gripping pad member on the upper outer surface of the cylindrical container, press the sheet of wrapping film against the gripping pad member during extraction of the sheet of wrapping film through the slot, and restrict movement and prevent roll back of the extracted sheet of wrapping film.

The cutting frame is rigidly attached proximal to the first lengthwise edge of the slot above the gripping pad member and extends along the length of the cylindrical container. The cutting frame comprises a protruding element located at a predetermined location, for example, a mid-section of the cutting frame. The protruding element is configured to cut the sheet of wrapping film extracted out through the slot, when the cylindrical container is twisted with a single hand of a user. The protruding element is configured to extend outwardly by a predetermined distance from the upper outer surface of the cylindrical container for retaining a portion of a first sheet of wrapping film of a predetermined length at the slot of the cylindrical container for subsequent extraction of second sheet of wrapping film, after the protruding element cuts the first sheet of wrapping film.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1:
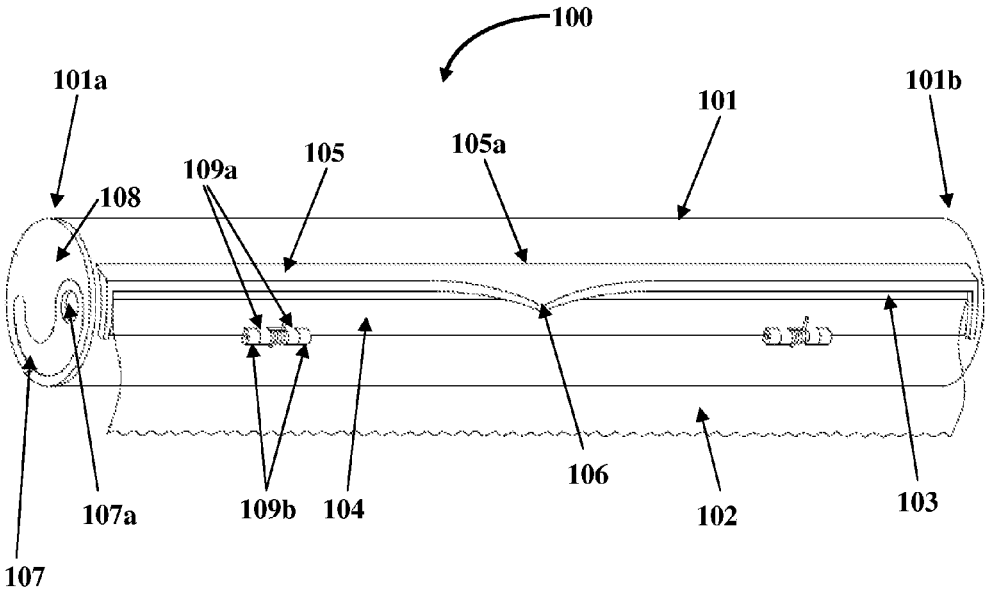
FIG. 1 exemplarily illustrates a front isometric view of a wrapping film dispenser.

FIG. 1 exemplarily illustrates a front isometric view of a wrapping film dispenser 100. The wrapping film dispenser 100 disclosed herein comprises a generally cylindrical container 101. For purposes of illustration, the detailed description refers to a container 101 of a generally cylindrical shape; however the scope of the wrapping film dispenser 100 disclosed herein is not limited to a container 101 of a generally cylindrical shape but may be extended to include a container having any shape configured to conform to a shape of a roll 102*a* of wrapping film 102 as exemplarily illustrated in FIGS. 13-14, for accommodating the roll 102*a* of wrapping film 102. The container 101 may therefore have, for example, a cuboidal shape for accommodating a cuboidal shaped roll of wrapping film 102. The wrapping film 102 is, for example, a thin sheet of a flexible laminate plastic film, a metallic foil, etc., that may be used for wrapping or packaging an item such as a food item.

Figure 2:
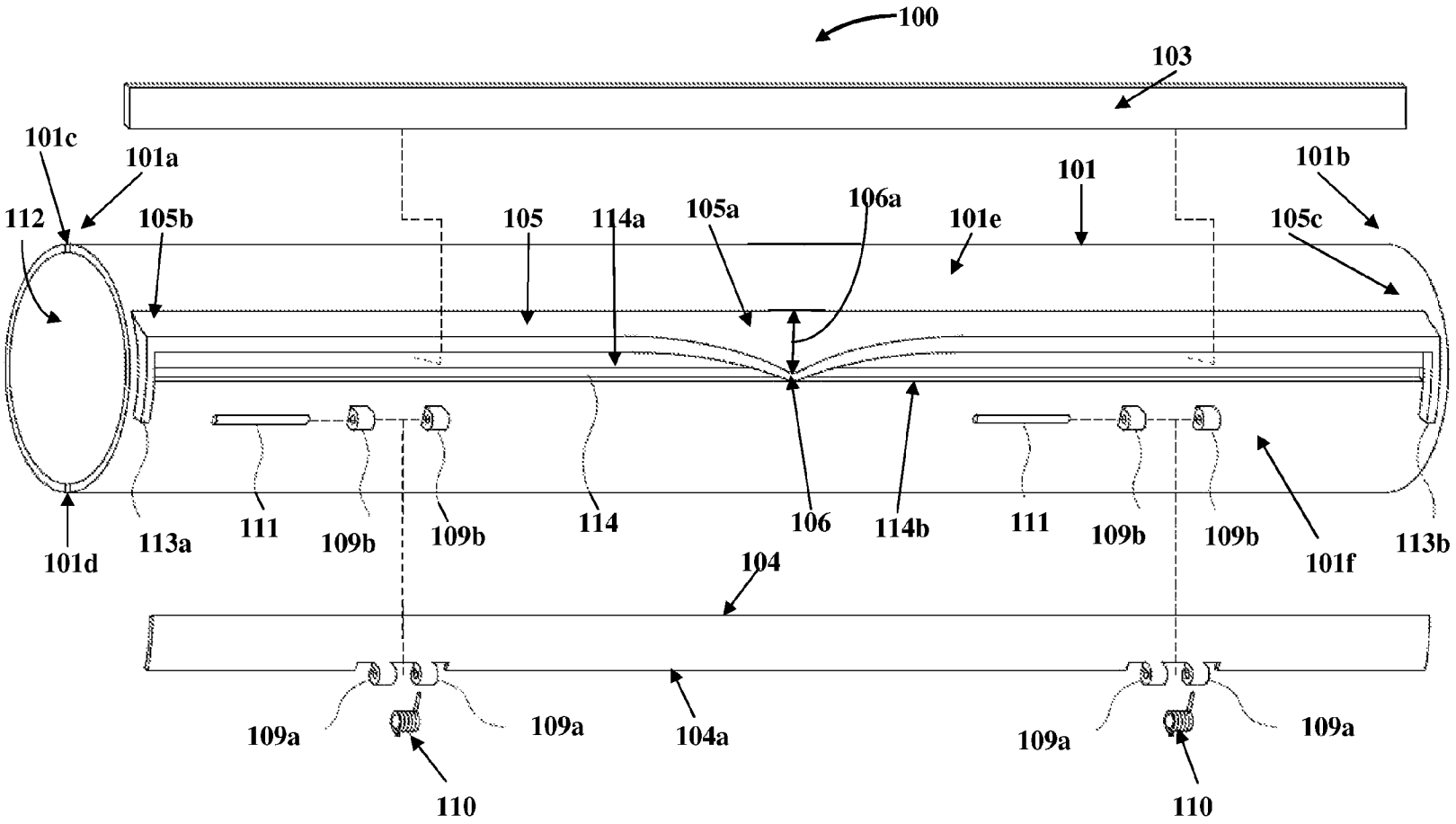
FIG. 2 exemplarily illustrates an exploded isometric view of the wrapping film dispenser.

The cylindrical container 101 defines a slot 114 having a first lengthwise edge 114*a* and a second lengthwise edge 114*b* as exemplarily illustrated in FIG. 2. The slot 114 extends along the length of the cylindrical container 101 for extracting a sheet of wrapping film 102 through the slot 114. A lid 108, exemplarily illustrated in FIGS. 7A-7E, covers an open one of the opposing ends 101*a* and 101*b* of the cylindrical container 101, that is, the open opposing end 101*a* as exemplarily illustrated in FIG. 1. In an embodiment, the other opposing end 101*b* of the cylindrical container 101 is sealed. The lid 108 accommodates a key member 107 having an opening 107*a* as disclosed in the detailed description of FIGS. 8A-8B. The wrapping film dispenser 100 disclosed herein further comprises a gripping pad member 103, a locking element 104 rigidly attached to the cylindrical container 101 by hinge members 109*a* and 109*b*, and a cutting frame 105 having a protruding element 106 as disclosed in the detailed description of FIG. 2.

FIG. 2 exemplarily illustrates an exploded isometric view of the wrapping film dispenser 100. The cylindrical container 101 of the wrapping film dispenser 100 disclosed herein defines a cavity 112 configured to accommodate a roll 102*a* of wrapping film 102 as exemplarily illustrated in FIGS. 13-14. FIG. 2 also exemplarily illustrates the slot 114 of the cylindrical container 101 having a first lengthwise edge 114*a* and a second lengthwise edge 114*b*. The gripping pad member 103 of the wrapping film dispenser 100 disclosed herein is rigidly attached on an upper outer surface 101*e* of the cylindrical container 101 at the first lengthwise edge 114*a* of the slot 114. The gripping pad member 103 extends along the length of the cylindrical container 101. The gripping pad member 103 is made of a gripping material, for example, rubber. The locking element 104 of the wrapping film dispenser 100 is rigidly attached on a lower outer surface 101*f* of the cylindrical container 101 proximal to the second lengthwise edge 114*b* of the slot 114. The locking element 104 extends along the length of the cylindrical container 101.

The lower lengthwise edge 104*a* of the locking element 104 is rigidly attached on the lower outer surface 101*f* of the cylindrical container 101 proximal to the second lengthwise edge 114*b* of the slot 114, for example, by connecting the hinge members 109*a* extending from the lower lengthwise edge 104*a* of the locking element 104 to the hinge members 109*b* positioned on the lower outer surface 101*f* of the cylindrical container 101. The hinge members 109*a* and 109*b* are connected to each other by first positioning a spring 110 between the hinge members 109*a* and then positioning the hinge members 109*a* with the spring 110 between the hinge members 109*b* and thereafter inserting a pin 111 through the hinge members 109*a* and 109*b*. The locking element 104 is configured, for example, as an arch shaped metallic element to conform to the shape of the lower outer surface 101*f* of the cylindrical container 101 as exemplarily illustrated in FIG. 4. The locking element 104 is configured to extend from the lower outer surface 101*f* of the cylindrical container 101 towards the gripping pad member 103 on the upper outer surface 101*e* of the cylindrical container 101 as exemplarily illustrated in FIG. 4.

The cutting frame 105 of the wrapping film dispenser 100 disclosed herein is rigidly attached proximal to the first lengthwise edge 114*a* of the slot 114 above the gripping pad member 103. The cutting frame 105 extends horizontally along the length of the cylindrical container 101. The cutting frame 105 comprises a protruding element 106 located at a predetermined location, for example, a mid-section 105*a* of the cutting frame 105. The protruding element 106 of the cutting frame 105 is configured to extend outwardly by a predetermined distance 106*a* from the upper outer surface 101*e* of the cylindrical container 101. The protruding element 106 is configured to cut the sheet of wrapping film 102 extracted out through the slot 114, when the cylindrical container 101 is twisted by a user using a single hand. The configuration of the protruding element 106 allows a user to conveniently and safely cut the sheet of wrapping film 102 extracted out through the slot 114. Arch shaped guide members 113*a* and 113*b* are positioned at the opposing ends 105*b* and 105*c* respectively, of the cutting frame 105. The guide members 113*a* and 113*b* are, for example, about 4 millimeters (mm) off the upper outer surface 101*e* of the cylindrical container 101. The distance between the guide members 113*a* and 113*b* at the opposing ends 105*b* and 105*c* respectively, of the cutting frame 105 is, for example, of the same length as the length of the slot 114. As exemplarily illustrated in FIG. 2, the opposing end 101*a* of the cylindrical container 101 comprises notches 101*c* and 101*d* positioned diametrically opposite to each other. The notches 101*c* and 101*d* are configured to receive connectors 108*a* and 108*g* respectively, of the lid 108 exemplarily illustrated in FIGS. 7A-7E.

Figure 3:
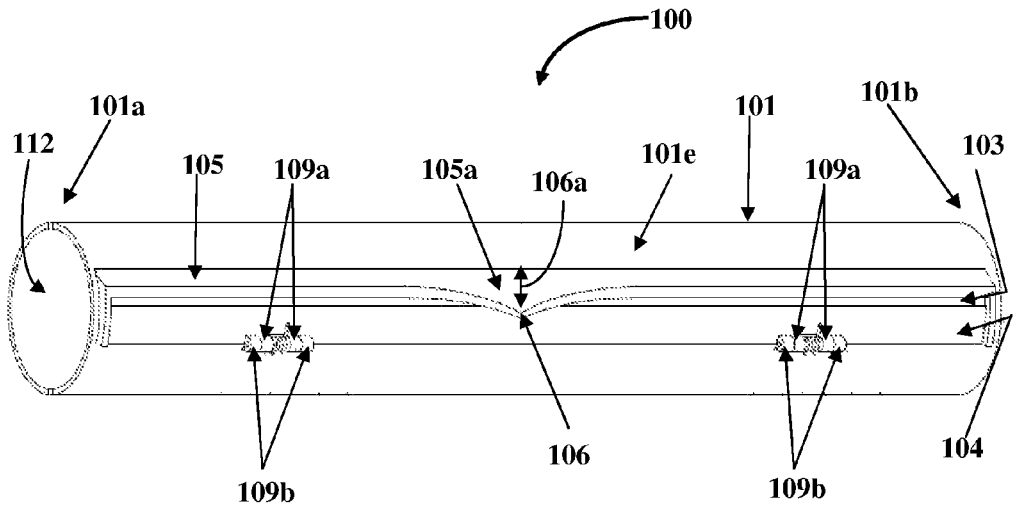
FIG. 3 exemplarily illustrates a front isometric view of the wrapping film dispenser prior to insertion of a roll of wrapping film into a cavity of a cylindrical container of the wrapping film dispenser.
Figure 18:
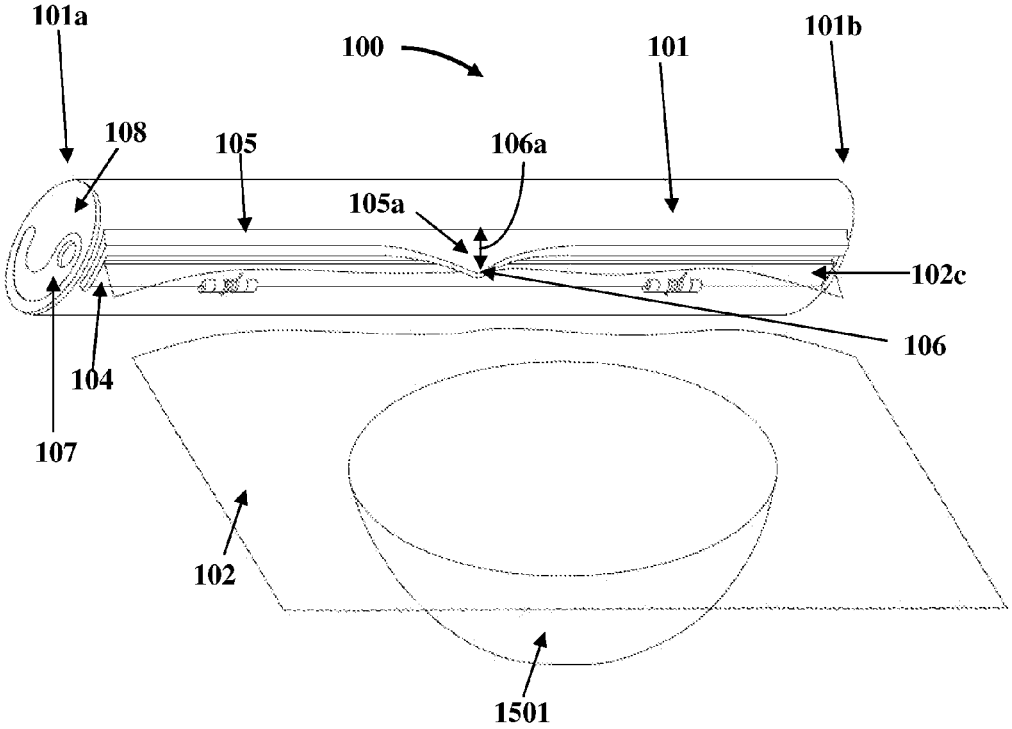
FIG. 18 exemplarily illustrates a front isometric view, showing a portion of the sheet of wrapping film of a predetermined length retained at the slot of the cylindrical container after cutting the sheet of wrapping film, for subsequent extraction of another sheet of wrapping film.

FIG. 3 exemplarily illustrates a front isometric view of the wrapping film dispenser 100 prior to insertion of a roll 102*a* of wrapping film 102 into the cavity 112 of the cylindrical container 101 of the wrapping film dispenser 100. The cavity 112 defined in the cylindrical container 101 accommodates the roll 102*a* of wrapping film 102 as exemplarily illustrated in FIGS. 13-14. The gripping pad member 103 and the cutting frame 105 having the protruding element 106 are mounted on the upper outer surface 101*e* of the cylindrical container 101, while the locking element 104 is mounted on the lower outer surface 101*f* of the cylindrical container 101 as disclosed in the detailed description of FIGS. 1-2. The protruding element 106 located at the mid-section 105*a* of the cutting frame 105 has, for example, a tongue-like configuration. The protruding element 106 of the cutting frame 105 is configured to extend outwardly by a predetermined distance 106*a* from the upper outer surface 101*e* of the cylindrical container 101 for retaining a portion 102*c* of a first sheet of wrapping film 102 of a predetermined length at the slot 114 of the cylindrical container 101 as exemplarily illustrated in FIG. 18, for subsequent extraction of a second sheet of wrapping film 102 by a user, after the protruding element 106 cuts the first sheet of wrapping film 102. The protruding element 106 is located, for example, approximately 20 millimeters away from the upper outer surface 101*e* of the cylindrical container 101. The location of the protruding element 106 away from the cylindrical container 101 enables the retained portion 102*c* of the cut wrapping film 102 to project outside the slot 114 of the cylindrical container 101 for subsequent use.

Figure 4:
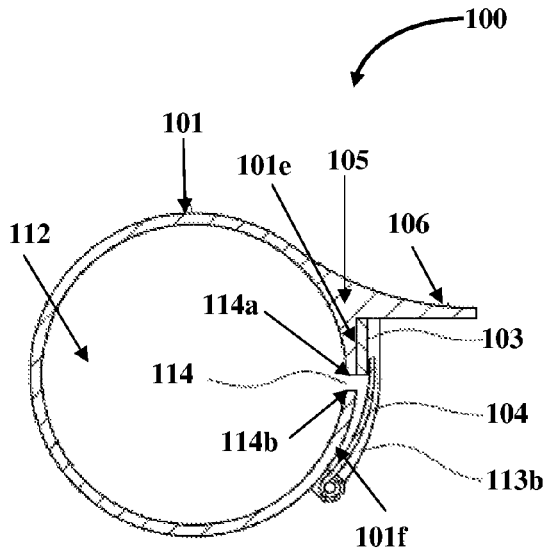
FIG. 4 exemplarily illustrates a side sectional view of the wrapping film dispenser, showing a locking element extending towards a gripping pad member.

FIG. 4 exemplarily illustrates a side sectional view of the wrapping film dispenser 100, showing the locking element 104 extending towards the gripping pad member 103. FIG. 4 shows the positioning of the gripping pad member 103 and the locking element 104 with respect to the first lengthwise edge 114*a* and the second lengthwise edge 114*b* respectively, of the slot 114 of the cylindrical container 101. The locking element 104 on the lower outer surface 101*f* of the cylindrical container 101 proximal to the second lengthwise edge 114*b* of the slot 114 extends towards the gripping pad member 103 on the upper outer surface 101*e* of the cylindrical container 101 and is configured to press the sheet of wrapping film 102 against the gripping pad member 103 during the extraction of the sheet of wrapping film 102 through the slot 114 as exemplarily illustrated in FIG. 14, and to restrict movement and prevent roll back of the extracted sheet of wrapping film 102 as disclosed in the detailed description of FIG. 14.

Figure 5:
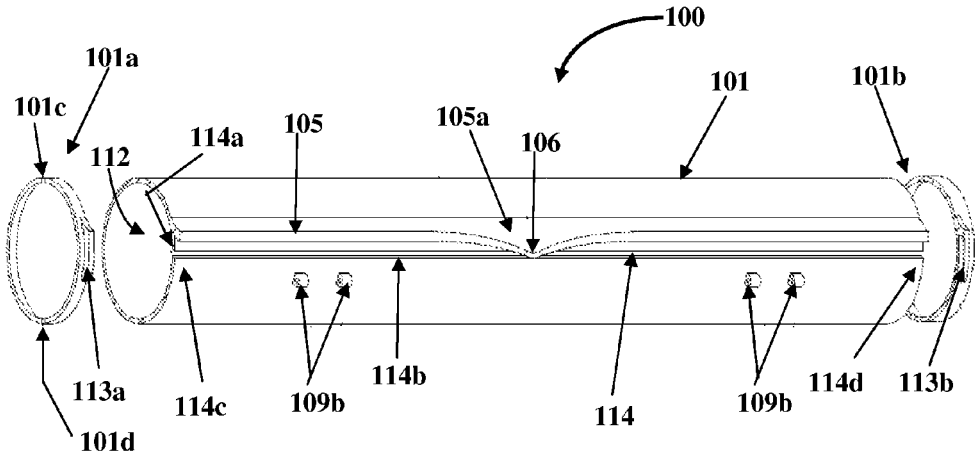
FIG. 5 exemplarily illustrates an isometric view of the wrapping film dispenser, showing the opposing ends of the cylindrical container with guide members of a cutting frame, cut away from the cylindrical container.

FIG. 5 exemplarily illustrates an isometric view of the wrapping film dispenser 100, showing the opposing ends 101*a* and 101*b* of the cylindrical container 101 with the guide members 113*a* and 113*b* respectively of the cutting frame 105, cut away from the cylindrical container 101. When assembled as exemplarily illustrated in FIG. 2, the guide members 113*a* and 113*b* positioned at the opposing ends 105*b* and 105*c* respectively of the cutting frame 105, support the cutting frame 105 and enable the wrapping film 102 to be extracted efficiently. The guide members 113*a* and 113*b* are configured to ensure that the wrapping film 102 is drawn out smoothly from the slot 114 without being cut by the ends 114*c* and 114*d* of the slot 114 even when the user draws out the wrapping film 102 in a non-linear manner. Furthermore, the guide members 113*a* and 113*b* guide the movement of the locking element 104.

Figure 6:
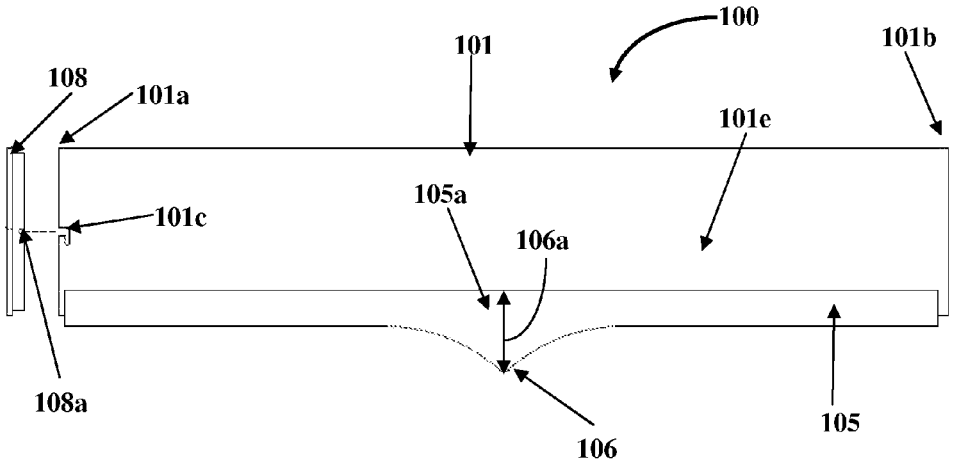
FIG. 6 exemplarily illustrates a top orthographic view of the wrapping film dispenser, showing the cutting frame and a lid.

FIG. 6 exemplarily illustrates a top orthographic view of the wrapping film dispenser 100, showing the cutting frame 105 and the lid 108. The lid 108 covers an open opposing end 101*a* of the cylindrical container 101. The lid 108 is attached to the cylindrical container 101 by inserting the connector 108*a* of the lid 108 into the notch 101*c* defined on the opposing end 101*a* of the cylindrical container 101 for locking the lid 108 to the cylindrical container 101. The diametrically opposite connector 108*g* (not shown in FIG. 6) of the lid 108 is simultaneously inserted into the diametrically opposite notch 101*d* (not shown in FIG. 6) defined on the opposing end 101*a* of the cylindrical container 101. FIG. 6 also shows the outward extension of the protruding element 106 of the cutting frame 105 by a predetermined distance 106*a* from the upper outer surface 101*e* of the cylindrical container 101. The outward extension of the protruding element 106 of the cutting frame 105 allows a portion 102*c* of the sheet of wrapping film 102 of a predetermined length to be retained at the slot 114 of the cylindrical container 101 as exemplarily illustrated in FIG. 18, after a user cuts the sheet of wrapping film 102, for subsequent extraction of another sheet of wrapping film 102 by the user.

FIGS. 7A-7E exemplarily illustrate different views of the lid 108 of the wrapping film dispenser 100 exemplarily illustrated in FIGS. 1-2. A front perspective view and a front orthographic view of the lid 108 of the wrapping film dispenser 100, showing an outer surface 108*b* of the lid 108 are exemplarily illustrated in FIG. 7A and FIG. 7B respectively. A complementary groove 108*c* is defined on the outer surface 108*b* of the lid 108 for receiving the key member 107 exemplarily illustrated in FIGS. 8A-8B, of the wrapping film dispenser 100. The complementary groove 108*c* is configured to complement the shape of the key member 107 to accommodate the key member 107. That is, the profile of the complementary groove 108*c* conforms to the profile of the key member 107. In an embodiment, an opening 108*d* is defined in the complementary groove 108*c*. The diameter of the opening 108*d* of the complementary groove 108*c* is larger than the diameter of the opening 107*a* of the key member 107, which allows a user to hold an edge of the opening 107*a* of the key member 107 to disengage the key member 107 from the complementary groove 108*c* of the lid 108.

Figure 7A:
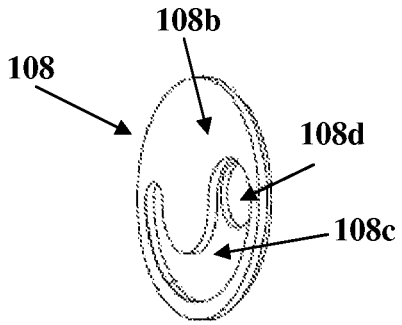
FIG. 7A exemplarily illustrates a front perspective view of a lid of the wrapping film dispenser.
Figure 7B:
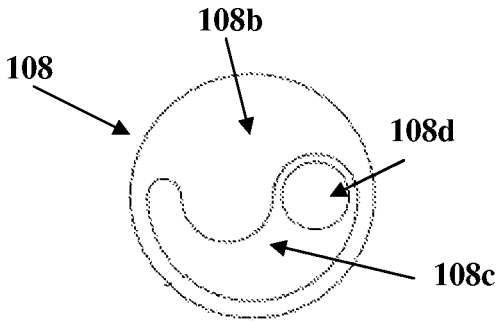
FIG. 7B exemplarily illustrates a front orthographic view of the lid of the wrapping film dispenser.
Figure 7C:
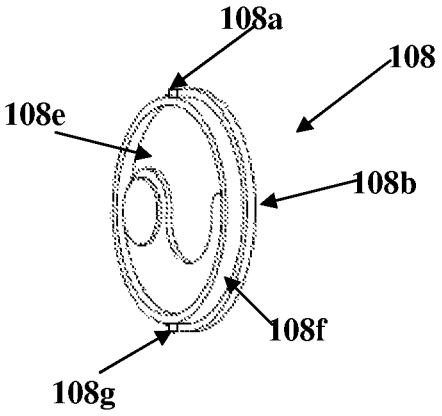
FIG. 7C exemplarily illustrates a rear perspective view of the lid of the wrapping film dispenser.
Figure 7D:
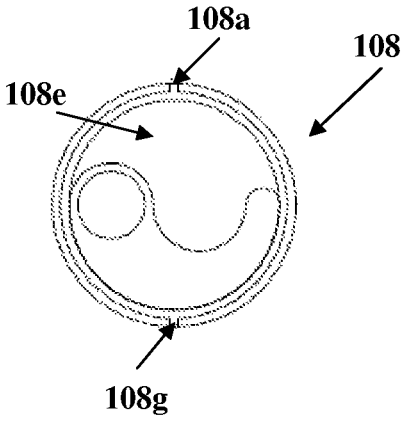
FIG. 7D exemplarily illustrates a rear orthographic view of the lid of the wrapping film dispenser.
Figure 7E:
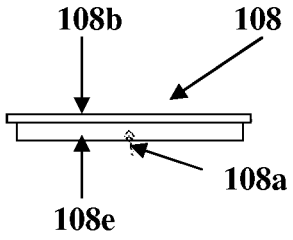
FIG. 7E exemplarily illustrates a top orthographic view of the lid of the wrapping film dispenser.

A rear perspective view and a rear orthographic view of the lid 108 of the wrapping film dispenser 100 showing an inner surface 108*e* of the lid 108 are exemplarily illustrated in FIG. 7C and FIG. 7D respectively. As exemplarily illustrated in FIG. 7C, the lid 108 has a recessed wall 108*f* that fits into the open opposing end 101*a* of the cylindrical container 101. A top orthographic view of the lid 108 of the wrapping film dispenser 100 is exemplarily illustrated in FIG. 7E. The lid 108 comprises connectors 108*a* and 108*g* positioned diametrically opposite to each other on the recessed wall 108*f* of the lid 108 as exemplarily illustrated in FIGS. 7C-7D. The connectors 108*a* and 108*g* of the lid 108 engage with the notches 101*c* and 101*d* respectively defined, for example, on the opposing end 101*a* of the cylindrical container 101, as exemplarily illustrated in FIGS. 2-3 and FIG. 5, for locking the lid 108 to the opposing end 101*a* of the cylindrical container 101, when the lid 108 is twisted against the opposing end 101*a* of the cylindrical container 101.

Figure 8A:
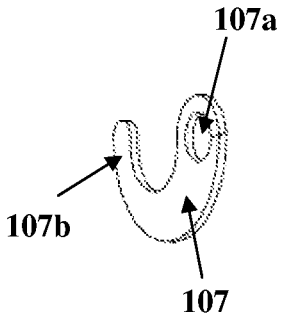
FIG. 8A exemplarily illustrates an isometric view of a key member of the wrapping film dispenser.
Figure 8B:
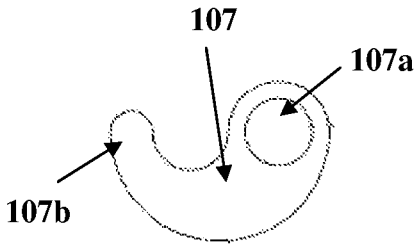
FIG. 8B exemplarily illustrates front orthographic view of the key member of the wrapping film dispenser.

FIG. 8A and FIG. 8B exemplarily illustrate an isometric view and a front orthographic view of the key member 107 of the wrapping film dispenser 100 respectively. The key member 107 has an opening 107*a* for inserting a leading edge 102*b* of the wrapping film 102 as exemplarily illustrated in FIG. 11, for guiding the roll 102*a* of wrapping film 102 into the cavity 112 of the cylindrical container 101 as exemplarily illustrated in FIG. 12, and for guiding the sheet of wrapping film 102 out through the slot 114 of the cylindrical container 101 as exemplarily illustrated in FIGS. 13-14. In an embodiment, the key member 107 comprises a curvedly extending blade member 107*b* configured for insertion into the slot 114 of the cylindrical container 101 as exemplarily illustrated in FIG. 12. A user may insert the leading edge 102*b* of the wrapping film 102 into the opening 107*a* of the key member 107 as exemplarily illustrated in FIG. 11, and then insert the blade member 107*b* of the key member 107 into the slot 114 of the cylindrical container 101 as exemplarily illustrated in FIG. 12, to guide the insertion of the roll 102*a* of wrapping film 102 into the cavity 112 of the cylindrical container 101. In an embodiment, the key member 107 is configured to fit into the complementary groove 108*a* defined on the lid 108 that covers the opposing end 101*a* of the cylindrical container 101 as disclosed in the detailed description of FIGS. 7A-7E.

Figure 9:
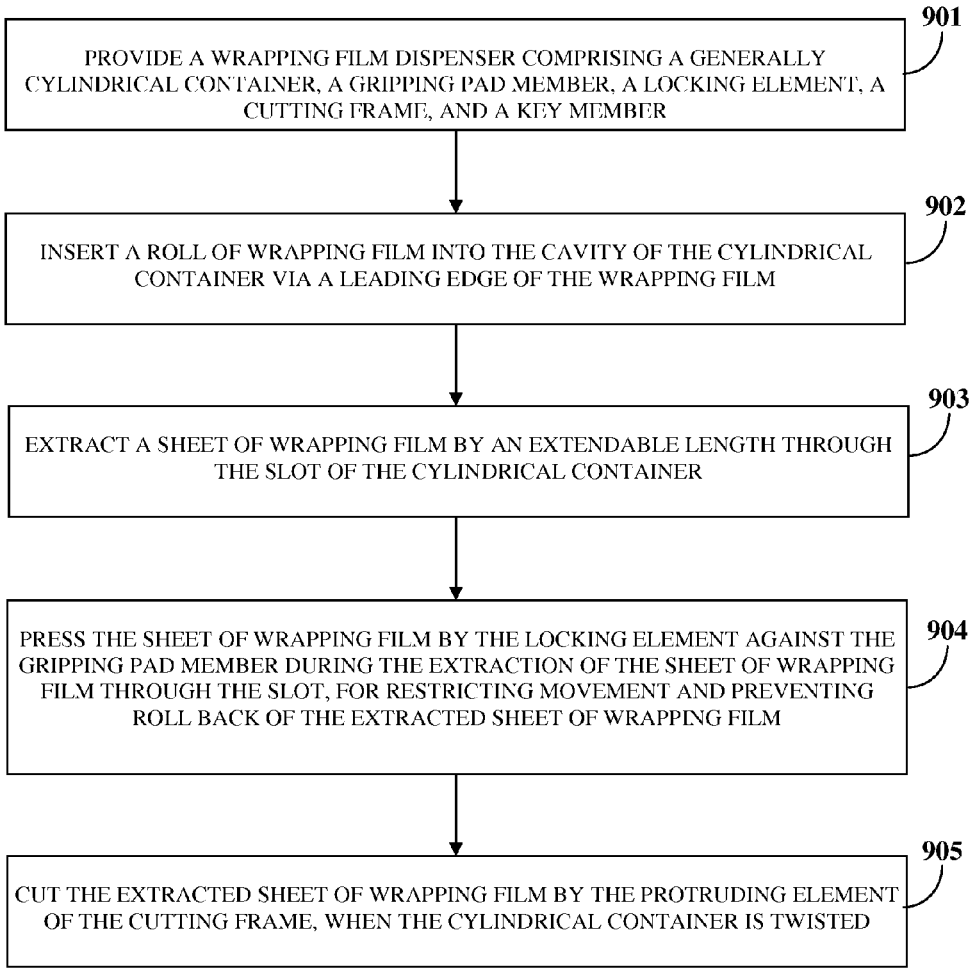
FIG. 9 exemplarily illustrates a method for dispensing a sheet of wrapping film.

FIG. 9 exemplarily illustrates a method for dispensing a sheet of wrapping film 102. A wrapping film dispenser 100 comprising a cylindrical container 101, a gripping pad member 103, a locking element 104, a cutting frame 105 having a protruding element 106, and a key member 107 as disclosed in the detailed description of FIGS. 1-8B, is provided 901.

A roll 102*a* of wrapping film 102 is inserted 902 into the cavity 112 of the cylindrical container 101 via a leading edge 102*b* of the wrapping film 102. For example, the leading edge 102*b* of the wrapping film 102 is inserted into the opening 107*a* of the key member 107 as exemplarily illustrated in FIG. 11. The key member 107 with the leading edge 102*b* of the wrapping film 102 in the opening 107*a* of the key member 107 is then guided into the slot 114 as exemplarily illustrated in FIG. 12, for guiding the roll 102*a* of the wrapping film 102 into the cavity 112 of the cylindrical container 101. A sheet of wrapping film 102 is extracted 903 by an extendable length through the slot 114 of the cylindrical container 101. The extraction of the sheet of wrapping film 102 by the extendable length allows the user to obtain a sufficient amount of the wrapping film 102 for wrapping an item of any size.

Figure 14:
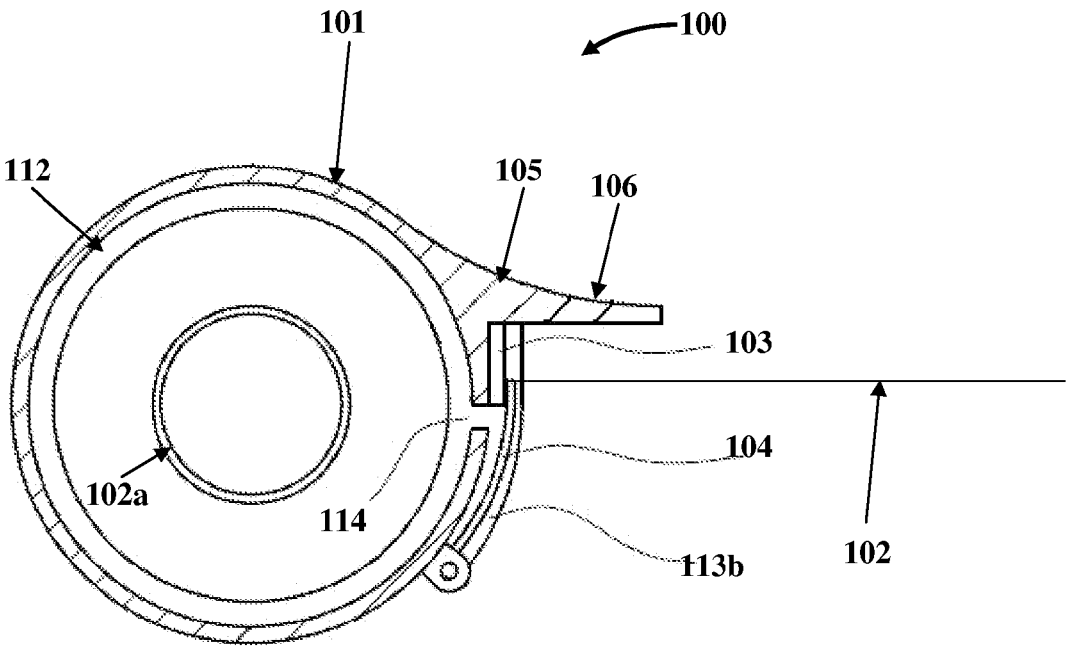
FIG. 14 exemplarily illustrates a side sectional view, showing pressing of the extracted sheet of wrapping film by the locking element against the gripping pad member.

The sheet of wrapping film 102 is pressed 904 by the locking element 104 against the gripping pad member 103 during the extraction of the sheet of wrapping film 102 through the slot 114, for restricting movement and preventing roll back of the extracted sheet of wrapping film 102 as exemplarily illustrated in FIG. 14. The extracted sheet of wrapping film 102 is cut 905 by the protruding element 106 of the cutting frame 105, when the cylindrical container 101 is twisted. The method disclosed herein allows a user to wrap an item, for example, a food item using the extracted sheet of wrapping film 102 of the extendable length prior to cutting of the extracted sheet of wrapping film 102, thereby allowing use of a sufficient amount of the wrapping film 102 for wrapping the item. After cutting the extracted sheet of wrapping film 102, the protruding element 106 that extends outwardly by a predetermined distance 106*a* from the upper outer surface 101*e* of the cylindrical container 101 retains a portion 102*c* of the sheet of wrapping film 102 of a predetermined length at the slot 114 as exemplarily illustrated in FIG. 18, for subsequent extraction of another sheet of wrapping film 102 by the user.

Figure 10:
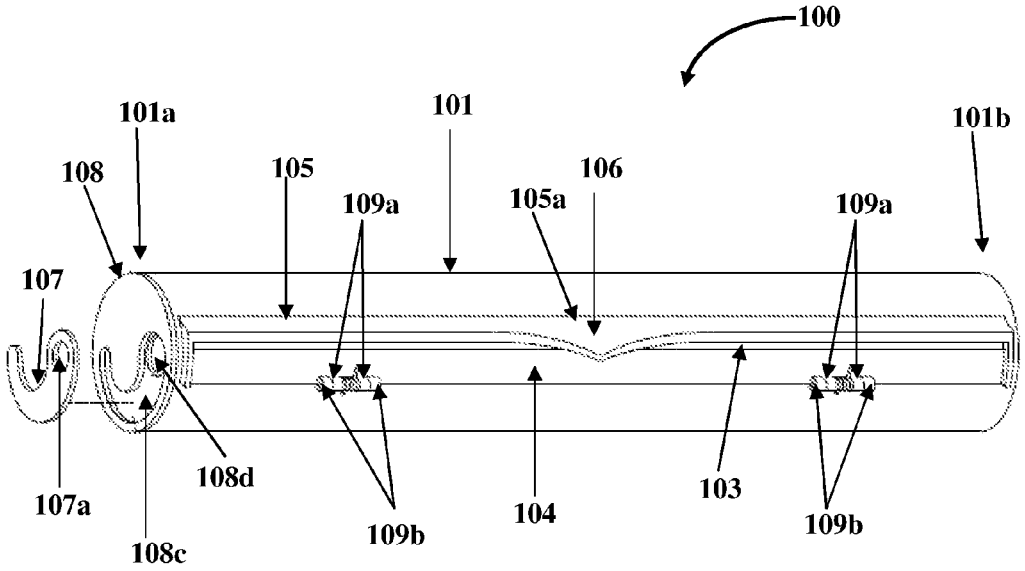
FIG. 10 exemplarily illustrates a front isometric view of the wrapping film dispenser, showing disengagement of the key member from the lid that covers an open opposing end of the cylindrical container.
Figure 11:
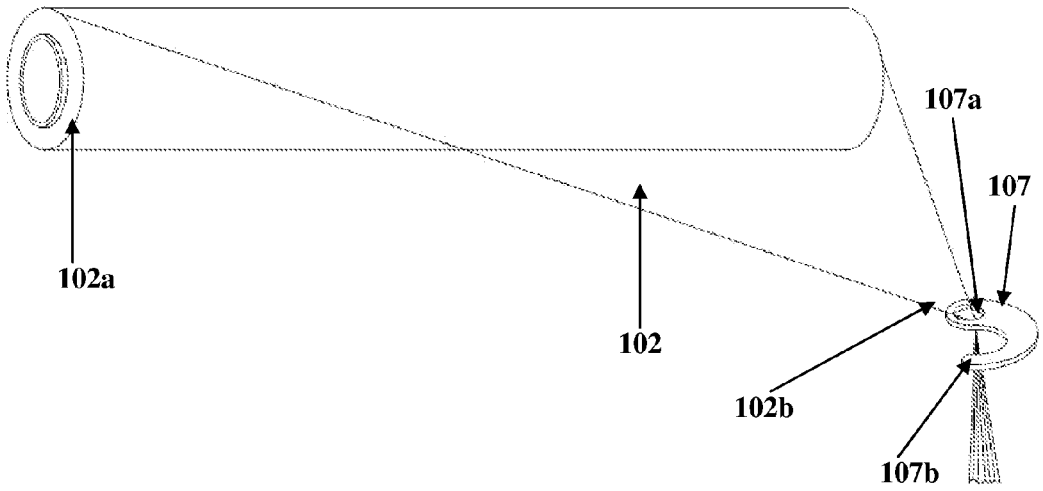
FIG. 11 exemplarily illustrates a front isometric view, showing insertion of a leading edge of a wrapping film through an opening of the key member of the wrapping film dispenser.
Figure 12:
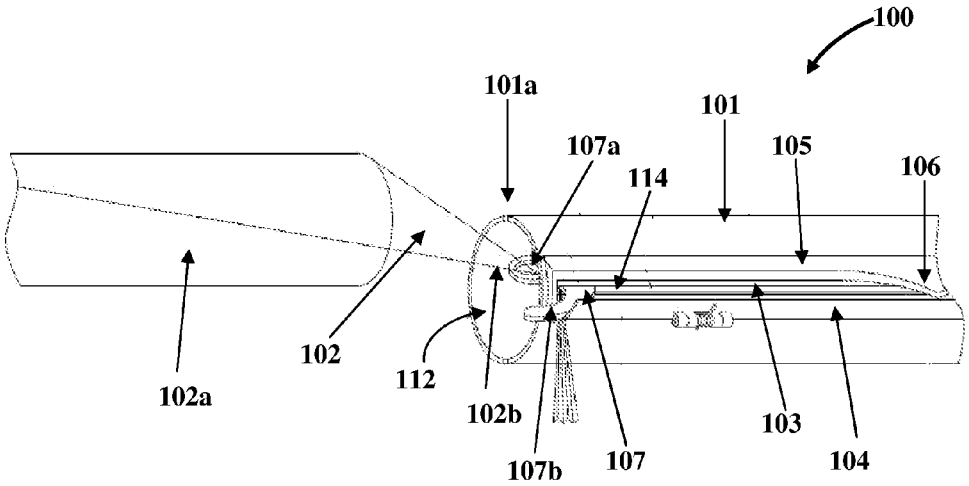
FIG. 12 exemplarily illustrates a front isometric view, showing insertion of a roll of wrapping film into the cavity of the cylindrical container via a leading edge of the wrapping film.

FIGS. 10-18 exemplarily illustrate a sequence of operations performed for dispensing a sheet of a wrapping film 102 using the wrapping film dispenser 100. Consider an example where a user wishes to wrap an item 1501, for example, a bowl containing a food item, exemplarily illustrated in FIGS. 15-18, using the wrapping film dispenser 100. The user disengages the key member 107 from the complementary groove 108*a* defined in the lid 108 of the wrapping film dispenser 100 as exemplarily illustrated in FIG. 10. FIG. 10 exemplarily illustrates a front isometric view of the wrapping film dispenser 100, showing disengagement of the key member 107 from the lid 108 that covers an open opposing end 101*a* of the cylindrical container 101. The user then inserts the leading edge 102*b* of the wrapping film 102 into the opening 107*a* of the key member 107 as exemplarily illustrated in FIG. 11. FIG. 11 exemplarily illustrates a front isometric view, showing insertion of the leading edge 102*b* of the wrapping film 102 through the opening 107*a* of the key member 107 of the wrapping film dispenser 100. The user then guides the key member 107 with the leading edge 102*b* of the wrapping film 102 into the slot 114 as exemplarily illustrated in FIG. 12, for guiding the roll 102*a* of the wrapping film 102 into the cavity 112 of the cylindrical container 101. FIG. 12 exemplarily illustrates a front isometric view, showing insertion of the roll 102*a* of wrapping film 102 into the cavity 112 of the cylindrical container 101 via the leading edge 102*b* of the wrapping film 102.

Figure 13:
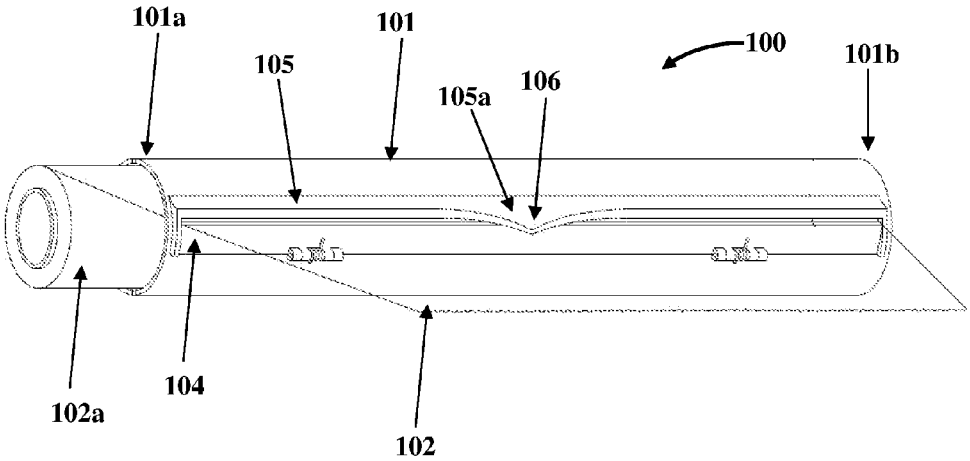
FIG. 13 exemplarily illustrates a front isometric view, showing extraction of a sheet of wrapping film through the slot of the cylindrical container of the wrapping film dispenser.
Figure 15:
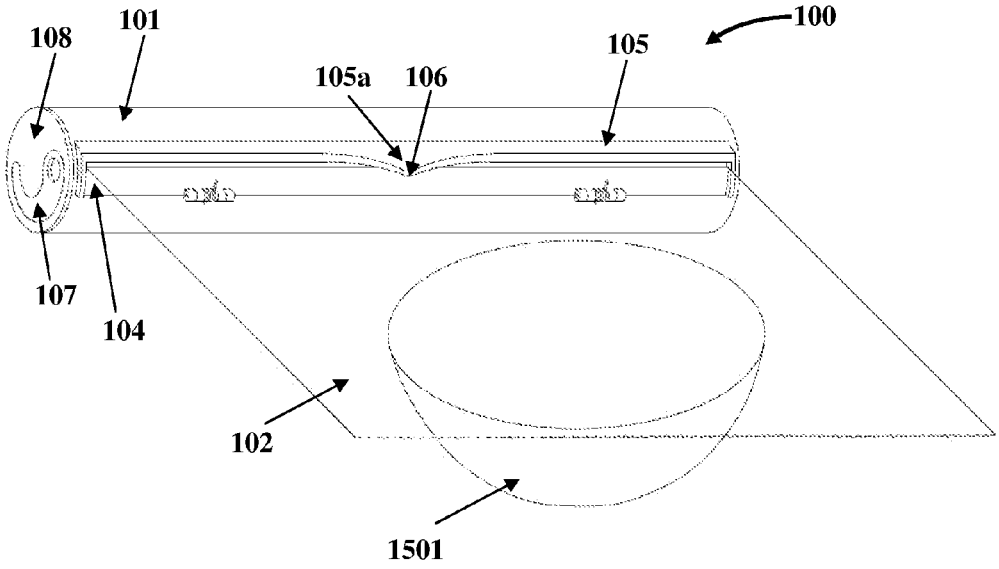
FIG. 15 exemplarily illustrates a front isometric view, showing wrapping of an item using a sheet of wrapping film extracted through the slot of the cylindrical container of the wrapping film dispenser.

The user then extracts several inches of the sheet of wrapping film 102 out through the slot 114 of the cylindrical container 101 as exemplarily illustrated in FIG. 13, by passing the sheet of wrapping film 102 between the gripping pad member 103 and the locking element 104. FIG. 13 exemplarily illustrates a front isometric view, showing the extraction of the sheet of wrapping film 102 through the slot 114 of the cylindrical container 101 of the wrapping film dispenser 100. The user may then cover the opposing end 101*a* of the cylindrical container 101 with the lid 108. The locking element 104 presses the extracted sheet of wrapping film 102 against the gripping pad member 103 for restricting movement and preventing roll back of the extracted sheet of wrapping film 102 as exemplarily illustrated in FIG. 14. FIG. 14 exemplarily illustrates a side sectional view, showing pressing of the extracted sheet of wrapping film 102 by the locking element 104 against the gripping pad member 103. The gripping pad member 103 and the locking element 104 tighten the wrapping film 102 to allow cutting of a sheet of wrapping film 102. The restriction of the movement of the extracted sheet of wrapping film 102 and prevention of roll back of the extracted sheet of wrapping film 102 allows the user to extract a sufficient amount of the wrapping film 102 for wrapping the item 1501 as exemplarily illustrated in FIG. 15. FIG. 15 exemplarily illustrates a front isometric view, showing wrapping of an item 1501 using a sheet of wrapping film 102 extracted through the slot 114 of the cylindrical container 101 of the wrapping film dispenser 100.

Figure 16:
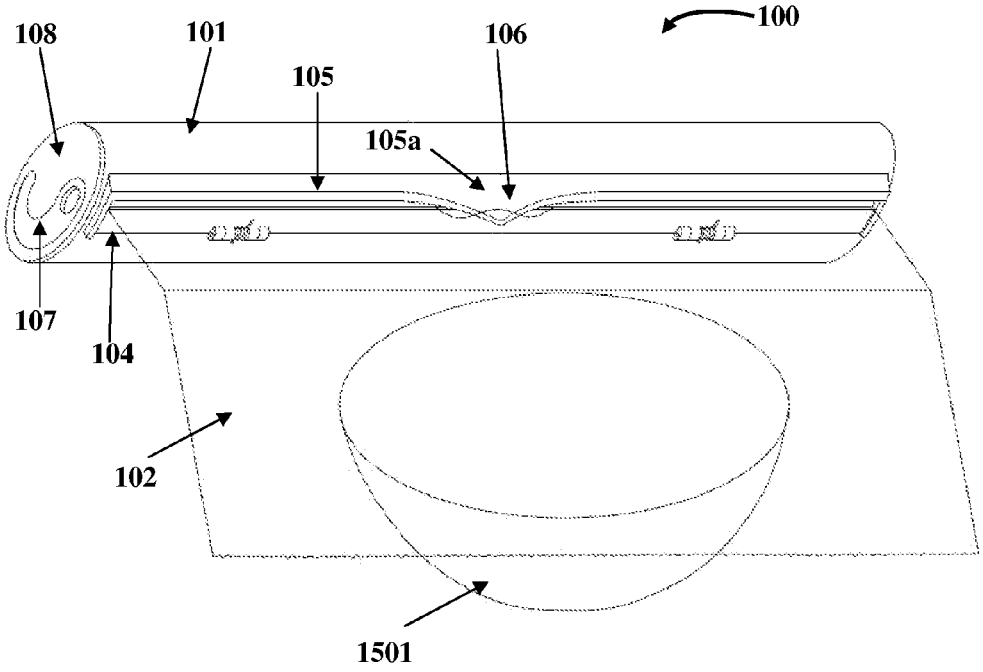
FIG. 16 exemplarily illustrates a front isometric view, showing cutting of the extracted sheet of wrapping film by a protruding element of the cutting frame mounted on the cylindrical container of the wrapping film dispenser.
Figure 17:
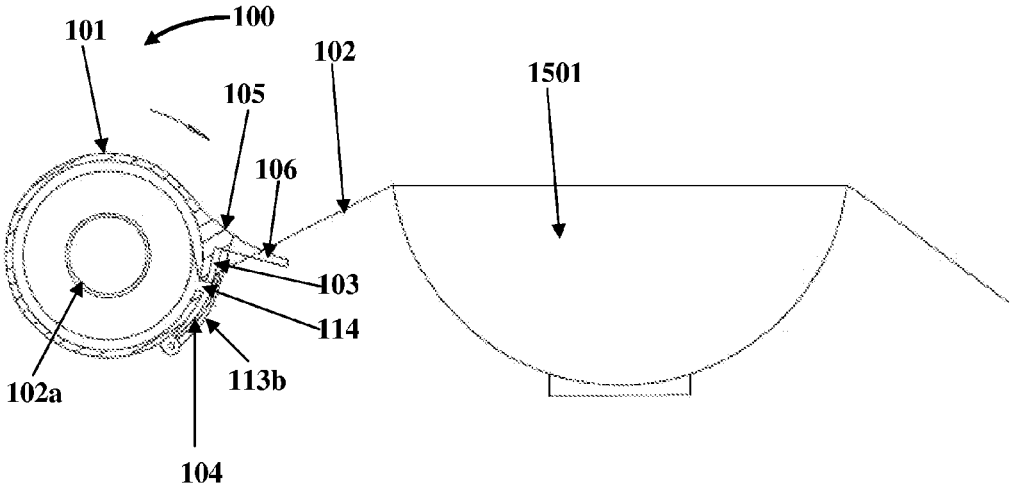
FIG. 17 exemplarily illustrates a side orthographic view, showing cutting of the extracted sheet of wrapping film by the protruding element of the cutting frame mounted on the cylindrical container of the wrapping film dispenser.

The user wraps the item 1501 with the extracted amount of the wrapping film 102 needed and uses his/her fingers to press the locking element 104 against the gripping pad member 103 to stretch and tighten the wrapping film 102. The user then twists the cylindrical container 101 to cut the extracted sheet of wrapping film 102 using the protruding element 106 of the cutting frame 105 as exemplarily illustrated in FIGS. 16-17, and pulls the cylindrical container 101 back with a single hand to tear the extracted sheet of wrapping film 102. FIG. 16 and FIG. 17 exemplarily illustrate a front isometric view and a side orthographic view, showing cutting of the extracted sheet of wrapping film 102 by the protruding element 106 of the cutting frame 105 mounted on the cylindrical container 101 of the wrapping film dispenser 100. After cutting the extracted sheet of wrapping film 102, a portion 102*c* of the sheet of wrapping film 102 of a predetermined length is retained at the slot 114 as exemplarily illustrated in a front isometric view in FIG. 18, for subsequent extraction of another sheet of wrapping film 102 by the user.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A method for dispensing a sheet of a wrapping film, comprising:

providing a wrapping film dispenser, comprising:

a generally cylindrical container defining a cavity configured to accommodate a roll of said wrapping film, said generally cylindrical container further defining a slot extending along a length of said generally cylindrical container;

a gripping pad member rigidly attached on an upper outer surface of said generally cylindrical container at a first lengthwise edge of said slot, said gripping pad member extending along said length of said generally cylindrical container;

a locking element rigidly attached on a lower outer surface of said generally cylindrical container proximal to a second lengthwise edge of said slot, said locking element extending along said length of said generally cylindrical container, wherein said locking element is configured to extend from said lower outer surface of said generally cylindrical container towards said gripping pad member on said upper outer surface of said generally cylindrical container; and a cutting frame rigidly attached proximal to said first lengthwise edge of said slot above said gripping pad member and extending along said length of said generally cylindrical container, said cutting frame comprising a protruding element located at a predetermined location on said cutting frame;

inserting said roll of said wrapping film into said cavity of said generally cylindrical container of said wrapping film dispenser via a leading edge of said wrapping film;

extracting said sheet of said wrapping film by an extendable length through said slot of said generally cylindrical container;

pressing said sheet of said wrapping film by said locking element of said wrapping film dispenser against said gripping pad member of said wrapping film dispenser during said extraction of said sheet of said wrapping film through said slot, for restricting movement and preventing roll back of said extracted sheet of said wrapping film; and cutting said extracted sheet of said wrapping film by said protruding element of said cutting frame of said wrapping film dispenser, when said generally cylindrical container is twisted;

whereby a user wraps an item using said extracted sheet of said wrapping film of said extendable length prior to said cutting of said extracted sheet of said wrapping film.

2. The method of claim 1, wherein said wrapping film dispenser further comprises a key member having an opening for inserting said leading edge of said wrapping film, guiding said roll of said wrapping film into said cavity of said generally cylindrical container, and guiding said sheet of said wrapping film out through said slot of said generally cylindrical container.

3. The method of claim 2, wherein said key member fits into a complementary groove defined on a lid that covers one of opposing ends of said generally cylindrical container.

4. The method of claim 1, further comprising retaining a portion of a first said sheet of said wrapping film of a predetermined length at said slot, by said protruding element of said cutting frame extending outwardly by a predetermined distance from said upper outer surface of said generally cylindrical container, for subsequent said extraction of a second said sheet of said wrapping film, after said cutting of said first said sheet of said wrapping film by said protruding element.

5. A wrapping film dispenser, comprising:

a generally cylindrical container defining a cavity configured to accommodate a roll of a wrapping film, said generally cylindrical container further defining a slot between a first lengthwise edge and a second lengthwise edge, said slot extending along a length of said generally cylindrical container for extracting a sheet of said wrapping film through said slot;

a gripping pad member rigidly attached on an upper outer surface of said generally cylindrical container at said first lengthwise edge of said slot, said gripping pad member extending along said length of said generally cylindrical container;

a locking element rigidly attached on a lower outer surface of said generally cylindrical container proximal to said second lengthwise edge of said slot, said locking element extending along said length of said generally cylindrical container, wherein said locking element is configured to extend from said lower outer surface of said generally cylindrical container towards said gripping pad member on said upper outer surface of said generally cylindrical container, press said sheet of said wrapping film against said gripping pad member during said extraction of said sheet of said wrapping film through said slot, and restrict movement and prevent roll back of said extracted sheet of said wrapping film;

a key member having an opening for inserting a leading edge of said wrapping film, guiding said roll of said wrapping film into said cavity of said generally cylindrical container, and guiding said sheet of said wrapping film out through said slot of said generally cylindrical container; and a cutting frame rigidly attached proximal to said first lengthwise edge of said slot above said gripping pad member and extending along said length of said generally cylindrical container, said cutting frame comprising a protruding element located at a predetermined location on said cutting frame, wherein said protruding element is configured to cut said sheet of said wrapping film extracted out through said slot when said generally cylindrical container is twisted.

6. The wrapping film dispenser of claim 5, wherein said key member is configured to fit into a complementary groove defined on a lid that covers one of opposing ends of said generally cylindrical container.

7. The wrapping film dispenser of claim 5, wherein said protruding element of said cutting frame is configured to extend outwardly by a predetermined distance from said upper outer surface of said generally cylindrical container for retaining a portion of a first said sheet of said wrapping film of a predetermined length at said slot for subsequent said extraction of a second said sheet of said wrapping film, after said protruding element cuts said first said sheet of said wrapping film.

8. The wrapping film dispenser of claim 5, wherein said locking element is rigidly attached on said lower outer surface of said generally cylindrical container proximal to said second lengthwise edge of said slot by hinge members.

* * * * *